US012448751B1

(12) United States Patent
Cao et al.

(10) Patent No.: US 12,448,751 B1
(45) Date of Patent: Oct. 21, 2025

(54) ANTI-FROST HEAVE PILE FOUNDATION SUPPORT DEVICE

(71) Applicant: NORTHWEST INSTITUTE OF ECO-ENVIRONMENT AND RESOURCES, CAS, Gansu (CN)

(72) Inventors: Yapeng Cao, Lanzhou (CN); Guoyu Li, Lanzhou (CN); Yanhu Mu, Lanzhou (CN); Yunhu Shang, Lanzhou (CN); Dun Chen, Lanzhou (CN); Shunshun Qi, Lanzhou (CN)

(73) Assignee: NORTHWEST INSTITUTE OF ECO-ENVIRONMENT AND RESOURCES, CAS, Lanzhou (CN)

( * ) Notice: Subject to any disclaimer, the term of this patent is extended or adjusted under 35 U.S.C. 154(b) by 0 days.

(21) Appl. No.: 19/256,023

(22) Filed: Jun. 30, 2025

(30) Foreign Application Priority Data

Oct. 18, 2024 (CN) ..... 202411456124.0

(51) Int. Cl.
*E02D 31/14* (2006.01)
*E02D 27/35* (2006.01)

(52) U.S. Cl.
CPC ..... *E02D 31/14* (2013.01); *E02D 27/35* (2013.01)

(58) Field of Classification Search
CPC ..... E02D 31/12; E02D 31/14; E02D 27/35; E02D 5/54; E02D 27/50
(Continued)

(56) References Cited

U.S. PATENT DOCUMENTS 3,630,037 A * 12/1971 Howard ..... E02D 5/226 405/231
3,703,812 A * 11/1972 Newton ..... E02D 5/54 52/170

(Continued)

FOREIGN PATENT DOCUMENTS

CN 106917406 A 7/2017
CN 114541488 A * 5/2022 ..... E02D 31/12

(Continued)

OTHER PUBLICATIONS

First Office Action in Chinese Application No. 202411456124.0 mailed on Nov. 26, 2024, 14 pages.

(Continued)

*Primary Examiner* — Sunil Singh
(74) *Attorney, Agent, or Firm* — PORUS IP LLC

(57) ABSTRACT

Embodiments of the present disclosure provide a frost-heave-resistant pile foundation support device including a pile foundation cylinder, a pile foundation cylinder top seat, a pile foundation cylinder base, and a frost heave penetration mechanism, wherein a top of the pile foundation cylinder is fixedly installed with the pile foundation cylinder top seat, and the pile foundation cylinder top seat is configured to connect to a target to be support; the pile foundation cylinder base is disposed at a bottom of the pile foundation cylinder, and a plurality of threaded drill rod assemblies are provided on the pile foundation cylinder; the frost heave penetration mechanism is fixedly installed on a cylindrical wall of the pile foundation cylinder. When soil undergoes frost heave action, a horizontal anchor rod of the frost heave penetration mechanism can penetrate laterally outward into the soil, so that the pile foundation cylinder is anchored to the surrounding soil, which serves as a frost-heave-resistant effect.

9 Claims, 9 Drawing Sheets

(58) Field of Classification Search
USPC .... 405/130, 157, 217, 231, 255, 256, 258.1, 405/302.4, 302.5
See application file for complete search history.

(56) References Cited

U.S. PATENT DOCUMENTS

| | | | | | |
|---|---|---|---|---|---|
| 3,706,204 | A * | 12/1972 | Long | E02D 27/35 | 405/234 |
| 4,585,681 | A * | 4/1986 | Kidera | E02D 5/60 | 405/234 |
| 6,179,526 | B1 * | 1/2001 | Knight | E02D 31/12 | 405/230 |
| 12,065,797 | B1 | 8/2024 | Li et al. | | |

FOREIGN PATENT DOCUMENTS

| | | | | | |
|---|---|---|---|---|---|
| CN | 115059122 | A * | 9/2022 | E02D 27/12 | |
| CN | 115653016 | A | 1/2023 | | |
| CN | 116575446 | A * | 8/2023 | E02D 5/74 | |
| CN | 116927232 | A | 10/2023 | | |
| CN | 118327056 | A * | 7/2024 | E02D 5/72 | |
| JP | S56105023 | A | 8/1981 | | |
| JP | 59085036 | A * | 5/1984 | | |
| JP | H08209719 | * | 8/1996 | | |
| WO | WO-2015147675 | A1 * | 10/2015 | E02D 27/35 | |

OTHER PUBLICATIONS

Notification to Grant Patent Right for Invention in Chinese Application No. 202411456124.0 mailed on Dec. 8, 2024, 4 pages.

* cited by examiner

ANTI-FROST HEAVE PILE FOUNDATION SUPPORT DEVICE

CROSS-REFERENCE TO RELATED APPLICATIONS

This application claims priority to the Chinese Patent application No. 202411456124.0, filed on Oct. 18, 2024, the contents of which are hereby incorporated by reference.

TECHNICAL FIELD

The present disclosure relates to a technical field of foundation support base, and in particular to a frost-heave-resistant pile foundation support device.

BACKGROUND

A permafrost region is also referred to as frozen soil, tundra, or a permafrost zone. In physical geography, the permafrost region refers to a region formed due to low temperatures and a short growing season. In geology, the permafrost region refers to various rocks and soils that are below 0° C. and contain ice. Generally, it can be divided into short-term frozen soil, seasonal frozen soil, and permafrost. Frost heave refers to a situation in seasonal frozen soil or permafrost regions where, during cold seasons, a support foundation fixed within the frozen soil layer is lifted due to tangential frost heave forces when the soil freezes and expands, resulting in loss of fixing effect. During thawing in warm seasons, the soil subsides, and the uplifted support foundation is difficult to return to its original position, resulting in a phenomenon of uplift.

At present, for the existing frost-heave-resistant (also referred to as anti-frost heave) support foundation structures, it is necessary to carry out large-area excavation in the original foundation and pour concrete over a large area to construct a stable supporting foundation. However, concrete often causes alkalization in the construction region, affecting the growth of surrounding vegetation. Therefore, the construction way will cause ecological damage to a nature reserve.

In view of this, it is necessary to propose a frost-heave-resistant supporting foundation structure suitable for use in permafrost regions.

SUMMARY

One or more embodiments of the present disclosure provide a frost-heave-resistant pile foundation support device, comprising: a pile foundation cylinder, a pile foundation cylinder top seat, a pile foundation cylinder base, and a frost heave penetration mechanism, wherein a top of the pile foundation cylinder is fixedly installed with the pile foundation cylinder top seat, the pile foundation cylinder top seat is configured to connect to a target to be support; the pile foundation cylinder base is disposed at a bottom of the pile foundation cylinder, and a plurality of threaded drill rod assemblies are provided on the pile foundation cylinder base for anchoring to a foundation; the frost heave penetration mechanism is fixedly installed on a cylindrical wall of the pile foundation cylinder, and the frost heave penetration mechanism includes: an L-shaped main pipe, a sliding rod, a horizontal anchor rod, a frost heave force sensing base, a movable soil-retaining device, and a liquid capsule, wherein the L-shaped main pipe includes a horizontal pipe section at top and a vertical pipe section, a mounting block is fixedly disposed inside the vertical pipe section of the L-shaped main pipe, the sliding rod is vertically slidably mounted within the mounting block, a limit plate is fixedly disposed at a middle portion of the sliding rod, a spring is arranged between the limit plate and the mounting block, and a limit protrusion is provided inside a bottom end of the vertical pipe section of the L-shaped main pipe to restrict the limit plate; a first piston is disposed at a top end of the sliding rod; the horizontal anchor rod is slidably mounted within the horizontal pipe section of the L-shaped main pipe, and a second piston is disposed at a rear end of the horizontal anchor rod; the frost heave force sensing base is disposed at a bottom end of the sliding rod, and the movable soil-retaining device is arranged between the frost heave force sensing base and the vertical pipe section of the L-shaped main pipe; the liquid capsule is embedded inside the movable soil-retaining device, a liquid channel is provided inside the sliding rod, and a through-hole is centrally disposed in the first piston, the through-hole communicates with the liquid channel of the sliding rod, and the liquid capsule communicates with a bottom side of the liquid channel of the sliding rod via a connecting pipe, such that the liquid capsule communicates with an internal space of the L-shaped main pipe between the first piston and the second piston; the liquid capsule, the liquid channel of the sliding rod, and the internal space of the L-shaped main pipe between the first piston and the second piston are filled with hydraulic oil.

In some embodiments, the pile foundation cylinder base is configured as an inverted cone shape. The pile foundation cylinder base in the inverted cone shape enables foundation soil inside of a foundation hole to exert a downward compressive effect thereon.

In some embodiments, each of the plurality of the threaded drill rod assemblies includes a threaded barrel, a threaded drill rod, and a protective cap. The threaded barrel is fixedly disposed on the pile foundation cylinder base. The threaded drill rod is threadedly installed through the threaded barrel. The threaded drill rod is configured to drill into the foundation. The protective cap is mounted on a top end of the threaded drill rod.

In some embodiments, a frost heave penetration mechanism mounting bracket is provided on a cylindrical wall of the pile foundation cylinder, and the frost heave penetration mechanism is fixed to the frost heave penetration mechanism mounting bracket.

In some embodiments, a horizontal blocking arm is provided on the frost heave penetration mechanism mounting bracket, and the horizontal pipe section of the L-shaped main pipe is fixedly welded on the horizontal blocking arm.

In some embodiments, the movable soil-retaining device includes a top fixed cover and N-stage sliding sleeves. N is greater than or equal to 2. The top fixed cover is fixedly sleeved around a bottom of the vertical pipe section of the L-shaped main pipe. The N-stage sliding sleeves are sequentially slidably nested. An uppermost sliding sleeve is vertically slidably mounted within the top fixed cover. A lowermost sliding sleeve is fixedly sleeved on the frost heave force sensing base. In this way, during backfilling, the movable soil-retaining device can block the foundation soil. When the soil undergoes frost heave action, the movable soil-retaining device can prevent the surrounding soil from exerting a downward force on the frost heave force sensing base. Moreover, N-stage sliding sleeves can extend and retract vertically, so it will not impede the upward movement of the frost heave force sensing base.

In some embodiments, a front end of the horizontal anchor rod is formed as a tapered tip structure to facilitate penetrating outward into the soil; and the horizontal anchor rod is further provided with barbs to facilitate stabilization in the soil after penetration.

In some embodiments, a limit ring is further provided at a front end of the horizontal pipe section of the L-shaped main pipe, and is configured to restrict a maximum outward displacement of the horizontal anchor rod, preventing the horizontal anchor rod from disengaging.

In some embodiments, there are a plurality of frost heave penetration mechanisms, which are circumferentially and evenly disposed on a cylindrical wall of the pile foundation cylinder.

In some embodiments, when backfilling and embedding the pile foundation cylinder, the horizontal anchor rod is positioned inside the horizontal pipe section of the L-shaped main pipe; after completion of the backfilling and embedding, when soil undergoes the frost heave action, the frost heave force sensing base is forced to move upward, simultaneously, the movable soil-retaining device is compressed to drive the sliding rod to move vertically upward to actuate the horizontal anchor rod to penetrate laterally outward into the soil.

In some embodiments, when the soil undergoes the frost heave action, during the movable soil-retaining device is compressed, the liquid capsule is squeezed, forcing the hydraulic oil in the liquid capsule to flow, through the liquid channel of the sliding rod and the through-hole of the first piston, into the internal space of the L-shaped main pipe, to increase an oil pressure within the L-shaped main pipe and enhance a driving force on the second piston to prompt outward extension of the horizontal anchor rod.

Compared with the prior art, the present disclosure has the following beneficial effects:

1. The frost-heave-resistant pile foundation support device of the present disclosure is simple to construct. During construction, the foundation hole is excavated, a threaded drill rod is installed, and then the foundation soil is backfilled. There is no need for large-area excavation in the original foundation or pouring of concrete (concrete often causes alkalization in the construction region, which affects the growth of surrounding vegetation). It is especially suitable for natural reserves in permafrost regions, avoiding ecological damage.
2. The frost-heave-resistant pile foundation support device of the present disclosure includes the frost heave penetration mechanism, wherein the frost heave force sensing base is configured to sense the frost heave force of the soil and drive the sliding rod to move upward under the frost heave force. Before the frost heave occurs, the bottom end of the sliding rod extends beyond a bottom of the vertical pipe section of the L-shaped main pipe, reserving space for upward movement. When backfilling the foundation soil, the movable soil-retaining device ensures that there is a movement space between the frost heave force sensing base and the bottom of the vertical pipe section of the L-shaped main pipe. There is no foundation soil in the movement space, which is not affected by the downward frost heave force of the soil. At the same time, the movable soil-retaining device allows the frost heave force sensing base to move upward. After completion of the backfilling and embedding, when soil undergoes the frost heave action, the frost heave force sensing base is forced to move upward, simultaneously, the movable soil-retaining device is compressed to drive the sliding rod to move vertically upward to actuate the horizontal anchor rod to penetrate laterally outward into the soil. In addition, the liquid capsule is embedded inside the movable soil-retaining device of the frost heave penetration mechanism in the present disclosure, and the liquid channel is provided inside the sliding rod, the liquid capsule communicates with the bottom side of the liquid channel of the sliding rod via the connecting pipe, such that the liquid capsule communicates with the internal space of the L-shaped main pipe between the first piston and the second piston. In this way, after completion of the backfilling and embedding, when the soil undergoes the frost heave action, during the movable soil-retaining device is compressed, the liquid capsule is squeezed, forcing the hydraulic oil in the liquid capsule to flow, through the liquid channel of the sliding rod and the through-hole of the first piston, into the internal space of the L-shaped main pipe, to increase an oil pressure within the L-shaped main pipe and enhance a driving force on the second piston to prompt outward extension of the horizontal anchor rod.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
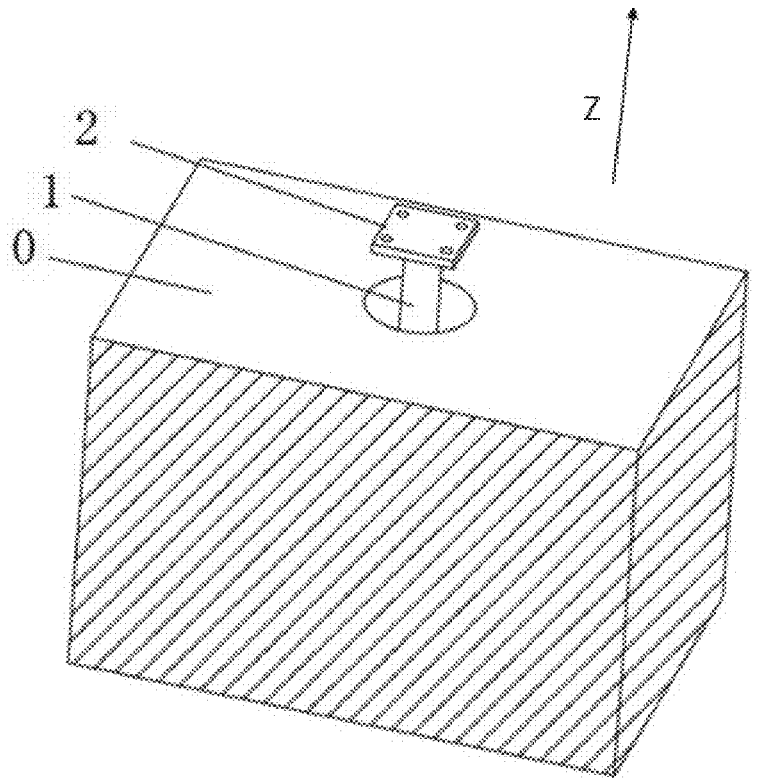
FIG. 1 is a schematic diagram of installation of a frost-heave-resistant pile foundation support device according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. Unless obviously obtained from the context or the context illustrates otherwise, the same numeral in the drawings refers to the same structure or operation.

Figure 2:
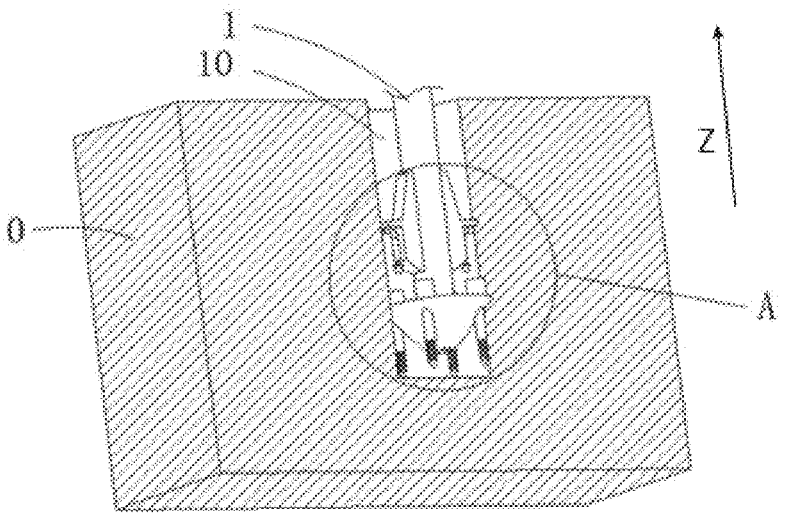
FIG. 2 is a schematic diagram illustrating a structure of a frost-heave-resistant pile foundation support device according to some embodiments of the present disclosure.
Figure 3:
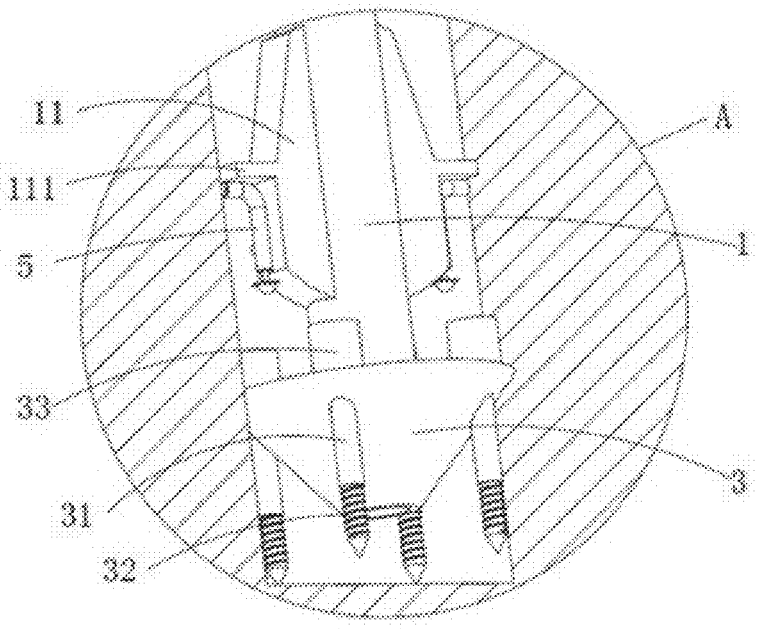
FIG. 3 is an enlarged schematic diagram at A of FIG. 2.

FIG. 1 is a schematic diagram of installation of a frost-heave-resistant pile foundation support device according to some embodiments of the present disclosure. FIG. 2 is a schematic diagram illustrating a structure of a frost-heave-resistant pile foundation support device according to some embodiments of the present disclosure. FIG. 3 is an enlarged schematic diagram at A of FIG. 2. The frost-heave-resistant pile foundation support device is also referred to as an anti-frost heave pile foundation support device.

As shown in FIG. 1, FIG. 2, and FIG. 3, a frost-heave-resistant pile foundation support device includes a pile foundation cylinder 1, a pile foundation cylinder top seat 2, a pile foundation cylinder base 3, and a frost heave penetration mechanism 5.

The pile foundation cylinder 1 serves as a mounting base for installing the pile foundation cylinder top seat 2 and the pile foundation cylinder base 3, and for carrying a target to be supported. In some embodiments, the pile foundation cylinder 1 is configured as a cylindrical structure. The pile foundation cylinder 1 may be made of a plurality of materials, such as concrete, reinforced concrete, steel, or the like.

In some embodiments, the pile foundation cylinder 1 is installed in a foundation 0. During construction, first, a foundation hole 10 is excavated in the foundation 0. Then the pile foundation cylinder 1 is installed into the foundation hole 10 and backfilled.

The foundation 0 refers to a portion of earth or rock that serves as a support base underneath the target to be supported. The foundation 0 may include a natural foundation and an artificial foundation. The natural foundation refers to natural soil or rock formation that requires no artificial reinforcement, such as a rock layer, a gravel soil layer, a sand soil layer, a silt soil layer, a clay soil layer, etc. The artificial foundation refers to soil or rock formation that requires artificial reinforcement, such as a stone chip cushion layer, a sand cushion layer, a mixed lime soil layer, etc. The artificial foundation needs to be compacted using a compactor.

In some embodiments, the axis of the foundation hole 10 may be set along a vertical direction (e.g., the Z direction in FIG. 1). The axis of the pile foundation cylinder 1 may be parallel to the axis of the foundation hole 10.

A top of the pile foundation cylinder 1 is fixedly installed with the pile foundation cylinder top seat 2, and the pile foundation cylinder top seat 2 is configured to connect to a target to be supported. For example, the pile foundation cylinder top seat 2 is connected to the target to be supported, such as a pipeline, a road pole, etc. In some embodiments, the pile foundation cylinder top seat 2 is configured as a plate-like structure. The material of the pile foundation cylinder top seat 2 may be the same as the pile foundation cylinder 1. The pile foundation cylinder top seat 2 may be connected to the pile foundation cylinder 1 in various ways, such as threaded connection, welding, one-piece molding, or the like.

The pile foundation cylinder base 3 is disposed at a bottom of the pile foundation cylinder 1.

The upper surface of the pile foundation cylinder base 3 is connected to the pile foundation cylinder 1. When the foundation hole 10 is backfilled with foundation soil, the foundation soil inside the foundation hole 10 may exert a downward compressive effect on the upper surface of the pile foundation cylinder base 3, thereby enhancing the stability of the pile foundation cylinder 1.

In some embodiments, the pile foundation cylinder base 3 is configured as an inverted cone shape, i.e., the lower surface of the pile foundation cylinder base 3 is conical. When installing the pile foundation cylinder 1, the pile foundation cylinder base 3 of the inverted cone shape is able to penetrate into the foundation 0 and form a squeeze on the foundation 0, which is beneficial to enhancing the connection strength between the pile foundation cylinder base 3 and the foundation 0. At the same time, it is possible to increase the contact area between the pile foundation cylinder base 3 and the foundation 0. The foundation soil inside the foundation hole will exert a downward compressive effect on the pile foundation cylinder base 3, which can disperse the pressure of the pile foundation cylinder base 3 on the foundation 0 in all directions, and reduce the damage to the pile foundation cylinder base 3 on the foundation 0.

In some embodiments, a plurality of threaded drill rod assemblies are provided on the pile foundation cylinder base 3 for anchoring to the foundation.

In some embodiments, the threaded drill rod assembly includes a threaded barrel 31, a threaded drill rod 32, and a protective cap 33.

The threaded barrel 31 is configured as a barrel-like structure with internal threads. In some embodiments, the axis of the threaded barrel 31 is parallel to the axis of the pile foundation cylinder 1. The outer side of the threaded barrel 31 is connected to the pile foundation cylinder base 3. The threaded barrel 31 may extend through the pile foundation cylinder base 3. A plurality of threaded barrels 31 may be provided, and the plurality of threaded barrels 31 are annularly distributed in the circumferential direction of the pile foundation cylinder 1. The threaded barrel 31 is fixedly disposed on the pile foundation cylinder base 3. The threaded barrel 31 may be connected to the pile foundation cylinder base 3 in various ways, such as welding, one-piece molding, threaded connection, or the like.

The threaded drill rod 32 is threadedly installed through the threaded barrel 31. The threaded drill rod 32 is configured to drill into the foundation 0, which makes the pile foundation cylinder more stable. In some embodiments, the threaded drill rod 32 is provided with external threads adapted to the internal threads of the threaded barrel 31. The threaded connection enhances the connection strength between the threaded drill rod 32 and the threaded barrel 31, and the stability of the threaded drill rod 32. Moreover, the threaded connection helps to prevent soil, gravel, or the like from entering into the threaded barrel 31, which may cause wear on the threaded drill rod 32 or the threaded barrel 31. Through the threaded connection, it is also possible to utilize the threads to achieve self-locking, preventing the threaded drill rod 32 from loosening or retracting. An end of the threaded drill rod 32 toward the foundation 0 is configured as a cone structure, so as to make it more convenient for the threaded drill rod 32 to penetrate into the foundation 0.

The protective cap 33 is mounted on a top end of the threaded drill rod 32. The protective cap 33 is configured to protect the threaded drill rod 32, which may shield the connection between the threaded drill rod 32 and the threaded barrel 31, preventing soil from entering the space between the threaded drill rod 32 and the threaded barrel 31, thus reducing the wear between the threaded drill rod 32 and the threaded barrel 31. In some embodiments, the diameter of the protective cap 33 is larger than the diameter of the threaded drill rod 32. The protective cap 33 may be connected to the threaded drill rod 32 in various ways, such as threaded connection, welding, one-piece molding, or the like.

The frost heave penetration mechanism 5 is fixedly installed on a cylindrical wall of the pile foundation cylinder 1.

At least a portion of the frost heave penetration mechanism 5 is able to pass through an inner side wall of the foundation hole 10, thereby penetrating into the foundation 0, which may increase the stability of the pile foundation cylinder 1 and prevent the position of the pile foundation cylinder 1 from shifting.

In some embodiments, a frost heave penetration mechanism mounting bracket 11 is provided on the cylindrical wall of the pile foundation cylinder 1, and the frost heave penetration mechanism 5 is fixed to the frost heave penetration mechanism mounting bracket 11.

The frost heave penetration mechanism mounting bracket 11 serves as a mounting base for installing the frost heave penetration mechanism 5. In some embodiments, by increasing the length of the frost heave penetration mechanism mounting bracket 11 in the radial direction of the pile foundation cylinder 1, the distance from the frost heave penetration mechanism 5 to an inner side wall of the foundation hole 10 can be reduced, which results in a shorter travel of the portion of the frost heave penetration mechanism 5 that penetrates into the foundation 0, avoiding that the portion of the frost heave penetration mechanism 5 that penetrates into the foundation 0 forms a cantilevered structure that leads to a decrease in rigidity and strength. The frost heave penetration mechanism mounting bracket 11 may be connected to the pile foundation cylinder 1 in various ways, such as welding, one-piece molding, threaded connection, or the like.

Figure 4:
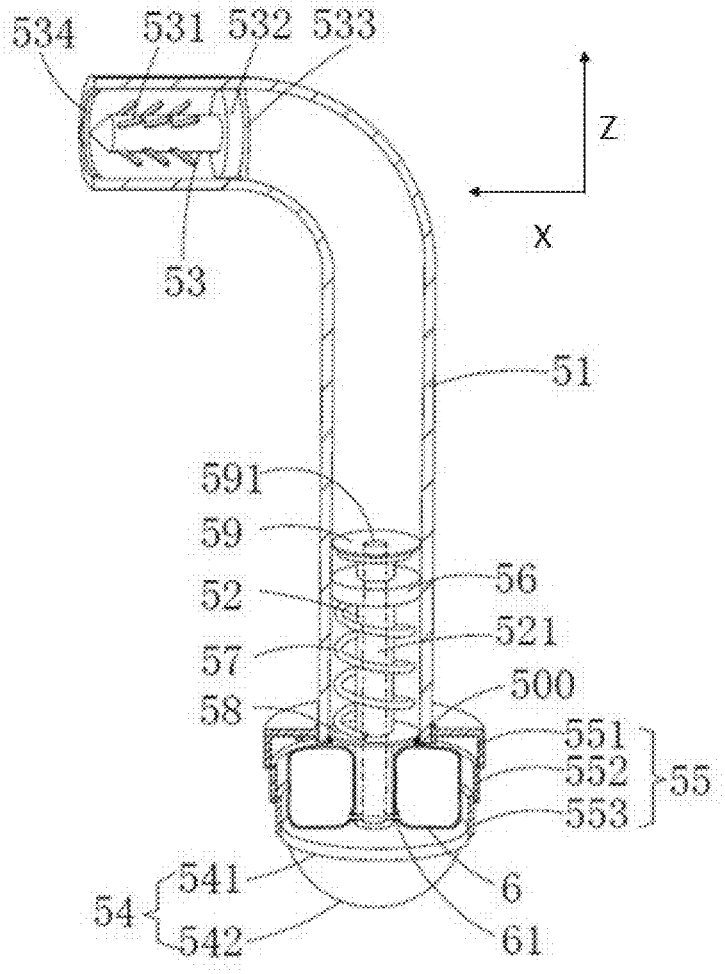
FIG. 4 is a schematic diagram illustrating a structure of a frost heave penetration mechanism with a horizontal anchor rod in a retracted state according to some embodiments of the present disclosure.
Figure 5:
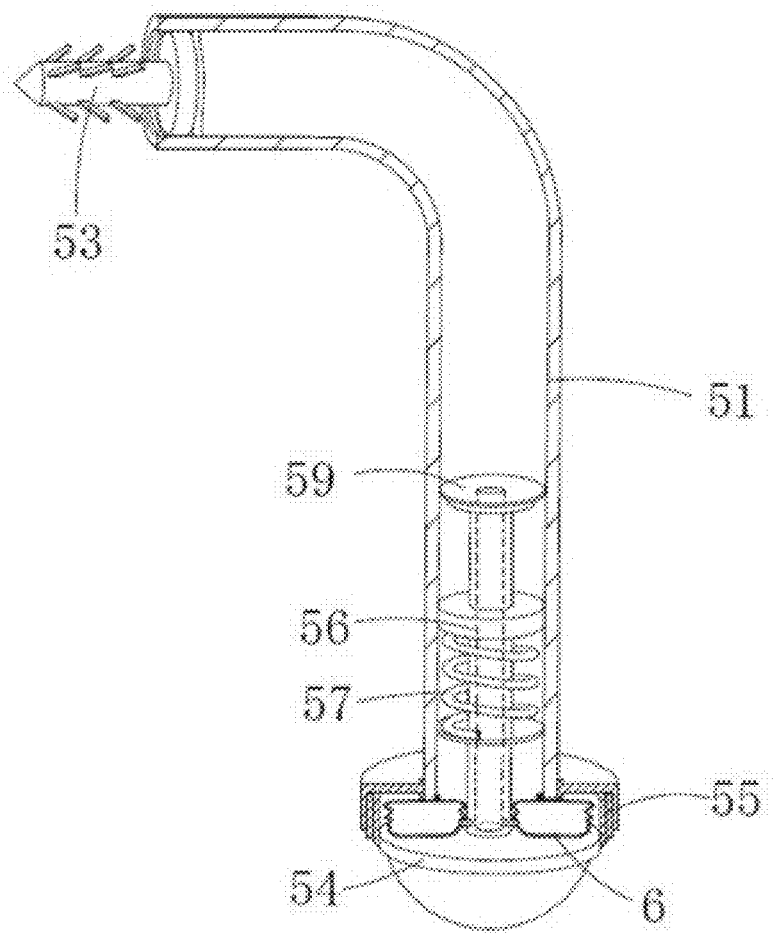
FIG. 5 is a schematic diagram illustrating a structure of a frost heave penetration mechanism with a horizontal anchor rod in a penetrating state according to some embodiments of the present disclosure.
Figure 6:
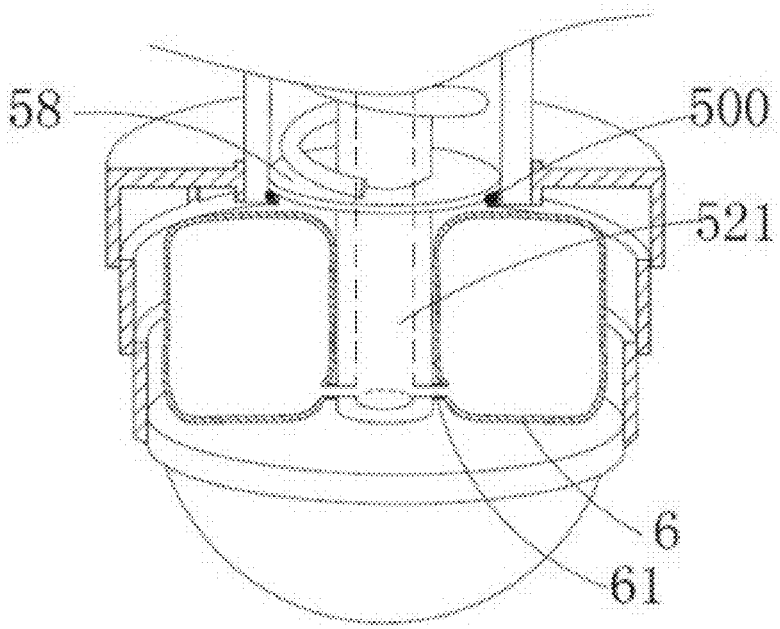
FIG. 6 is a partially enlarged schematic diagram of a frost heave penetration mechanism according to some embodiments of the present disclosure.

FIG. 4 is a schematic diagram illustrating a structure of a frost heave penetration mechanism with a horizontal anchor rod in a retracted state according to some embodiments of the present disclosure. FIG. 5 is a schematic diagram illustrating a structure of a frost heave penetration mechanism with a horizontal anchor rod in a penetrating state according to some embodiments of the present disclosure. FIG. 6 is a partially enlarged schematic diagram of a frost heave penetration mechanism according to some embodiments of the present disclosure.

In some embodiments, as shown in FIG. 4, FIG. 5, and FIG. 6, the frost heave penetration mechanism 5 includes an L-shaped main pipe 51, a sliding rod 52, a horizontal anchor rod 53, a frost heave force sensing base 54, a movable soil-retaining device 55, and a liquid capsule 6.

The L-shaped main pipe 51 is formed internally with a L-shaped through-hole for accommodating the sliding rod 52 and the horizontal anchor rod 53. In some embodiments, the L-shaped main pipe 51 is fixedly mounted (e.g., welded) to the frost heave penetration mechanism mounting bracket 11. The L-shaped main pipe 51 includes a horizontal pipe section at top and a vertical pipe section.

In some embodiments, since the L-shaped main pipe 51 of the frost heave penetration mechanism 5 is in an L shape, a horizontal blocking arm 111 (see FIG. 3) is provided on the frost heave penetration mechanism mounting bracket 11. The horizontal pipe section at the top of the L-shaped main pipe 51 is fixedly welded to the horizontal blocking arm 111 to ensure the stability of the L-shaped main pipe 51.

In some embodiments, the sliding rod 52 is vertically slidably mounted within the vertical pipe section of the L-shaped main pipe 51. Merely by way of example, a mounting block 56 is fixedly disposed within the vertical pipe section of the L-shaped main pipe 51. The mounting block 56 serves as a mounting base, and the sliding rod 52 is vertically slidably mounted within the mounting block 56. The sliding rod 52 may slide up and down in a vertical direction (e.g., the Z direction in FIG. 4). The mounting block 56 may be sealingly connected to an inner wall of the vertical pipe section in various ways, such as welding, one-piece molding, threaded connection, or the like. The sliding rod 52 is in a dynamic seal connection with the mounting block 56. The dynamic seal connection means that the sliding rod 52 and the mounting block 56 may remain sealed during relative movement.

In some embodiments, a limit plate 58 is fixedly disposed at a middle portion of the sliding rod 52. The limit plate 58 is disposed below the mounting block 56. A spring 57 is arranged between the limit plate 58 and the mounting block 56. The spring 57 is in a compressed state, so as to provide a downward spring force for the sliding rod 52. A limit protrusion 500 is provided inside a bottom end of the vertical pipe section of the L-shaped main pipe 51 to restrict a maximum downward displacement of the limit plate 58, and prevent the limit plate 58 from disengaging from the L-shaped main pipe 51.

In some embodiments, a first piston 59 is disposed at a top end of the sliding rod 52. The first piston 59 is in a dynamic seal connection with the inner wall of the L-shaped main pipe 51. When the sliding rod 52 moves, the sliding rod 52 drives the first piston 59 to move synchronously.

In some embodiments, the horizontal anchor rod 53 is slidably mounted within the horizontal pipe section of the L-shaped main pipe 51. One end of the horizontal anchor rod 53 facing an outer side of the L-shaped main pipe 51 is configured to penetrate into the foundation 0. One end of the horizontal anchor rod 53 facing an inner side of the L-shaped main pipe 51 is provided with a sliding guide member 532.

The sliding guide member 532 serves as a mounting base for supporting the horizontal anchor rod 53 to ensure the stability and positional accuracy of the horizontal anchor rod 53. The sliding guide member 532 is slidingly connected to the inner wall of the L-shaped main pipe 51 to ensure that the horizontal anchor rod 53 may move stably in the horizontal pipe section of the L-shaped main pipe 51 along a lateral direction (e.g., the X-direction in FIG. 4). A second piston 533 is further provided at an end of the sliding guide member 532 facing the inside of the L-shaped main pipe 51. The second piston 533 is in a dynamic seal connection with the inner wall of the L-shaped main pipe 51. The internal space of the L-shaped main pipe 51 between the first piston 59 and the second piston 533 is filled with hydraulic oil.

With the above structure, the first piston 59 exerts pressure on the hydraulic oil when the sliding rod 52 is moved vertically upward. The hydraulic oil exerts pressure on the second piston 533, which in turn actuates the horizontal anchor rod 53 to be pushed out laterally and outward along the horizontal pipe section of the L-shaped main pipe 51.

In some embodiments, a plurality of frost heave penetration mechanisms 5 are respectively arranged at different height positions of the cylindrical wall of the pile foundation cylinder 1, thereby increasing the count of the frost heave penetration mechanisms 5. When the soil undergoes the frost heave action, the plurality of frost heave penetration mechanisms 5 at different height positions penetrate into the soil, so that the pile foundation cylinder 1 is connected to the soil at the different height positions, which may further enhance the stability of the pile foundation cylinder 1.

In some embodiments, the frost heave penetration mechanisms 5 may be equally spaced in the height direction (e.g., the Z-direction in FIG. 2) of the pile foundation cylinder 1.

In some embodiments, the plurality of frost heave penetration mechanisms 5 are configured to: when different penetrating trigger conditions are triggered, a horizontal anchor rod of a corresponding frost heave penetration mechanism penetrates into the soil. The penetrating trigger condition is set based on frost heave force.

The frost heave force refers to the outward-acting force that occurs when water between soil particles in the soil freezes into ice, resulting in an increase in the volume of water and causing the soil particles to undergo relative displacement. When the soil undergoes the frost heave action, the soil disposed below the frost heave force sensing base 54 exerts an upward thrust on the frost heave force sensing base 54, thereby pushing the frost heave force sensing base 54 to move upward.

The penetrating trigger condition refers to a predetermined condition that triggers the horizontal anchor rod 53 of the frost heave penetration mechanism 5 to penetrate into the soil. In some embodiments, the penetrating trigger condition may include that the frost heave force is greater than a trigger threshold.

The trigger threshold is the maximum frost heave force that the frost heave penetration mechanism 5 may withstand under the condition that the horizontal anchor rod 53 does not penetrate into the soil. When the frost heave force exceeds the trigger threshold, the horizontal anchor rod 53 of the frost heave penetration mechanism 5 may penetrate into the soil. The trigger threshold is a preset value, which may be set according to actual needs.

In some embodiments, the trigger threshold is positively correlated to the spring force of the corresponding spring 57. The elasticity of the spring 57 is correlated to its own stiffness coefficient. For example, the greater the stiffness coefficient, the greater the spring force for stretching or compressing the same distance, and the higher the cost of the spring.

In some embodiments, the trigger threshold may be determined based on historical data. For example, based on a range of historical frost heave force corresponding to each region in the historical data, a staff may perform grade classification on the range of the historical frost heave force to obtain classified grades. The classified grades correspond to the count of the frost heave penetration mechanisms 5 at different heights. The staff determines the historical frost heave force corresponding to each grade as a corresponding trigger threshold. The trigger thresholds corresponding to the frost heave penetration mechanisms 5 at different heights increase sequentially from bottom to top.

In some embodiments, along the height direction of the pile foundation cylinder 1 (for example, the Z direction in FIG. 2) from top to bottom, the trigger threshold may gradually decrease, and the stiffness coefficient of the spring 57 may also gradually decrease. When the soil undergoes the frost heave action, the frost heave penetration mechanism 5 at the lowermost position may be preferentially triggered, so as to ensure the overall stability of the pile foundation cylinder 1.

In some embodiments, the frost-heave-resistant pile foundation support device further includes a processor.

The processor may be configured to store, analyze, and process data. For example, the processor may store the historical data and a preset algorithm, analyzing and processing the historical data based on the preset algorithm. In some embodiments, the processor may include a remote processor, a cloud server, or the like.

In some embodiments, the processor is configured to generate a plurality of candidate distribution schemes based on historical frost heave data, soil data, pile foundation data, and hydraulic data, and determine an optimal distribution scheme based on the plurality of candidate distribution schemes.

The historical frost heave data refers to data related to actual frost heave of the soil that has occurred over a historical time period. In some embodiments, the historical frost heave data may include a peak frost heave force, an average frost heave force, duration of frost heave, a distribution of frozen soil depth, a distribution of frost heave force, or the like, at the time when the soil undergoes the frost heave action. The processor may obtain the historical frost heave data in various ways, e.g., by manual input, reading from a database, etc. The database may be stored in the processor.

The soil data refers to data related to the soil in the foundation 0. In some embodiments, the soil data may include soil temperature, moisture content, density, soil type, frozen soil depth, etc. The soil data may be obtained by measurement.

The pile foundation data refers to data associated with the pile foundation cylinder 1. In some embodiments, the pile foundation data may include a weight, a burial depth, a diameter, or the like, of the pile foundation cylinder 1. The pile foundation data may be obtained by measurement.

The hydraulic data refers to data related to the hydraulic oil. In some embodiments, the hydraulic data may include a volume of the liquid capsule 6, a type of the hydraulic oil, or the like. The hydraulic data may be obtained from a manufacturer. More descriptions regarding the liquid capsule 6 may be found in the related descriptions below.

A candidate distribution scheme refers to a distribution scheme of the frost heave penetration mechanism 5 to be selected. In some embodiments, the distribution scheme may include a distribution parameter of the frost heave penetration mechanism 5. The distribution parameter may include a distribution depth, a distribution count, a distribution position, an anchor length, or the like.

The distribution depth refers to a depth of the frost heave penetration mechanism 5 compared to the surface of the foundation 0 after the pile foundation cylinder 1 is fixed. The distribution count refers to the count of the frost heave penetration mechanisms 5. The distribution position refers to a position of the frost heave penetration mechanism 5 compared to the pile foundation cylinder 1. The distribution position may be represented by coordinates.

The processor may construct a three-dimensional coordinate system based on the axis of the pile foundation cylinder 1. For example, the three-dimensional coordinate system is constructed by taking the axis of the pile foundation cylinder 1 as the Z-axis, the intersection point of the axis of the pile foundation cylinder 1 and the surface of the foundation 0 as the origin, and taking any two lines on the surface of the foundation 0 that intersect at the origin and are perpendicular to each other as the X-axis and Y-axis. The anchor length refers to a length of the horizontal anchor rod 53.

In some embodiments, the processor may generate a distribution parameter of the candidate distribution scheme based on a distribution determination model.

The distribution determination model refers to a model configured to determine the distribution parameter of the candidate distribution scheme. In some embodiments, the distribution determination model is a machine learning model, e.g., a Neural Networks (NN) model, etc.

The input of the distribution determination model includes the historical frost heave data, the soil data, the pile foundation data, and the hydraulic data, and the output includes the distribution parameter of the candidate distribution scheme.

In some embodiments, the processor may train the distribution determination model based on a first sample dataset.

The first sample dataset includes a first training sample and a corresponding first label.

In some embodiments, the first training sample includes sample historical frost heave data, sample soil data, sample pile foundation data, and sample hydraulic data. The first label is the distribution parameter that actually corresponds to each first training sample.

In some embodiments, the processor may determine a plurality of historical preferred schemes from the plurality of distribution schemes actually applied in the historical data. The processor determines the historical frost heave data, the soil data, the pile foundation data, and the hydraulic data corresponding to a historical preferred scheme as the first training sample. The processor determines the distribution parameter corresponding to the historical preferred scheme as the first label corresponding to the first training sample.

The historical preferred scheme refers to a distribution scheme with the best frost-heave-resistant effect of the pile foundation cylinder actually applied in the historical time period. In some embodiments, the processor may determine the historical preferred scheme in various ways. For example, the processor determines, among the plurality of distribution schemes that were actually applied in the historical data, the distribution scheme where the pile foundation cylinder is elevated by a height of 0 or a height less than a height threshold, as the historical preferred scheme. The height threshold is a preset value. The height threshold may be set according to actual needs.

In some embodiments, the processor may perform a plurality of rounds of iterations. At least one round of iteration includes: selecting one or more first training samples from the first sample dataset, inputting the one or more first training samples into an initial distribution determination model to obtain model prediction output(s) corresponding to the one or more first training samples; substituting the model prediction output(s) corresponding to the one or more first training samples and the first label(s) of the one or more first training samples into a formula for a predefined loss function to calculate a value of the loss function; and inversely updating a model parameter in the initial distribution determination model based on the value of the loss function. The update may be performed using a plurality of ways. For example, the update may be performed based on a gradient descent method. When an iteration end condition is satisfied, the iteration is ended, and the trained distribution determination model is obtained.

In some embodiments, the processor may input a plurality of sets of data into the distribution determination model. Each set of data includes corresponding historical frost heave data, soil data, pile foundation data, and hydraulic data. The distribution determination model may output a plurality of candidate distribution schemes, each of the plurality of candidate distribution schemes corresponding to one set of data of the plurality of sets of data. In some embodiments, the processor may determine the optimal distribution scheme based on the plurality of candidate distribution schemes.

The optimal distribution scheme refers to a distribution scheme, predicted from a plurality of candidate distribution schemes, in which the pile foundation cylinder has the best frost-heave-resistant effect and the equipment wear is low.

The equipment wear refers to the situation where the equipment undergoes wear due to the friction between structures during the operation process. For example, the equipment wear may include wear occurring on the first piston 59, the second piston 533, or the like.

In some embodiments, the processor may determine the optimal distribution scheme based on the plurality of candidate distribution schemes by a predetermined algorithm. For example, the predetermined algorithm may include a genetic algorithm, etc. The genetic algorithm may include an evaluation function. The evaluation function evaluates the corresponding frost-heave-resistant effect and equipment wear based on the candidate distribution scheme.

In some embodiments, the processor may determine the evaluation function based on experimental data. For example, in a simulated environment for testing, the processor installs the frost-heave-resistant pile foundation support device in different experimental soils. The horizontal anchor rod 53 is manually controlled to penetrate into the soil, and the experimental data under a plurality of operations are recorded. The experimental data may include an elevation dimension of the pile foundation cylinder, the equipment wear, or the like. The processor may analyze the experimental data in statistical ways (e.g., regression analysis) to establish the evaluation function for the frost-heave-resistant effect of a penetration mechanism and the level of wear. The statistical ways may include regression analysis.

Determining a plurality of candidate distribution schemes through the distribution determination model enables the automatic determination of the distribution schemes for a plurality of frost heave penetration mechanisms according to the actual situation of the foundation. Then, by selecting the distribution scheme with the best frost-heave-resistant effect from these schemes, it is conducive to improving the accuracy and efficiency of determining the distribution scheme of the frost heave penetration mechanisms. Moreover, it can adaptively adjust the distribution scheme according to the actual construction environment, making it applicable to a plurality of different construction environments.

A plurality of frost heave penetration mechanisms are provided at different height positions of the pile foundation cylinder. When the soil undergoes the frost heave action, the plurality of frost heave penetration mechanisms are utilized to fix the pile foundation cylinder and improve the stability of the pile foundation cylinder. By setting different triggering conditions, the springs with different stiffness coefficients can be selected according to actual needs, and the construction cost can be effectively controlled on the basis of guaranteeing the effect of frost heave resistance.

The function to be achieved in the present disclosure is that when the pile foundation cylinder 1 is backfilled and embedded, the horizontal anchor rod 53 is located inside the horizontal pipe section of the L-shaped main pipe 51. After completion of the backfilling and embedding, when the soil undergoes the frost heave action, under the effect of the frost heave force, the sliding rod 52 may move upward in the vertical direction, in turn, to drive the horizontal anchor rod 53 to penetrate laterally outward into the soil through the hydraulic oil. As a result, the pile foundation cylinder 1 is more stably anchored together with the surrounding soil, effectively preventing frost heave resistance.

In some embodiments, the frost heave force sensing base 54 is disposed at a bottom end of the sliding rod 52. The frost heave force sensing base 54 is configured to sense the frost heave force of the soil, and drive the sliding rod 52 to move upward under the action of the frost heave force. Before the frost heave occurs, the bottom end of the sliding rod 52 extends beyond a bottom of the vertical pipe section of the L-shaped main pipe 51, reserving space for upward movement. The space is a preset value, which may be set according to actual needs. Moreover, the area of the frost heave force sensing base 54 is larger than the cross-sectional area of the vertical pipe section of the L-shaped main pipe 51, ensuring that the frost heave force sensing base 54 has a sufficient contact area with the soil body, so that the frost heave force sensing base 54 can be fully affected by the frost heave force.

In some embodiments, the frost heave force sensing base 54 includes a circular base plate 541. Moreover, a hemispherical structure 542 is designed on the bottom surface of the base plate 541, which helps the frost heave force sensing base 54 to fully receive the frost heave force of the surrounding soil and convert the frost heave force into a vertical upward-acting force, thus pushing the sliding rod 52 to move upward.

In some embodiments, the movable soil-retaining device 55 is arranged between the frost heave force sensing base 54 and the vertical pipe section of the L-shaped main pipe 51. The movable soil-retaining device 55 may form a shield over the upper part of the frost heave force sensing base 54, which is configured to prevent the foundation soil from falling above the frost heave force sensing base 54, thus avoiding the frost heave force sensing base 54 from being affected by the downward frost heave force exerted by the foundation soil. That is, when the frost heave occurs, the frost heave force sensing base 54 is only subjected to the upward frost heave force. When backfilling the foundation soil, the movable soil-retaining device 55 ensures that there is a movement space between the frost heave force sensing base 54 and the bottom of the vertical pipe section of the L-shaped main pipe 51. There is no foundation soil in the movement space, so the frost heave force sensing base 54 is not affected by the downward frost heave force of the soil. At the same time, the movable soil-retaining device 55 allows the frost heave force sensing base 54 to move upward.

In some embodiments, the horizontal anchor rod 53 is configured as a retractable structure. By adopting the retractable structure, a length of the horizontal anchor rod penetrating into the soil can be increased, thereby enhancing the connection strength between the horizontal anchor rod and the soil, and further improving the stability of the pile foundation cylinder.

In some embodiments, the horizontal anchor rod 53 includes a horizontal outer rod and a horizontal inner rod. The horizontal outer rod is a hollow pipe. The horizontal outer rod is connected to the sliding guide member 532. The horizontal inner rod is slidably disposed within the horizontal outer rod. The sliding direction of the horizontal inner rod is parallel to the axial direction of the horizontal anchor rod. The sliding guide member 532 and the second piston 533 are provided with a through-hole that allows the hydraulic oil to flow into the horizontal outer rod.

In some embodiments, a preloaded spring is connected between the horizontal inner rod and the horizontal outer rod. The preloaded spring is in a compressed state. When the frost heave force borne by the frost heave force sensing base 54 is greater than the spring force of the preloaded spring, the frost heave force sensing base 54 squeezes the liquid capsule 6 under the action of the frost heave force, causing the hydraulic oil in the liquid capsule 6 to flow into the L-shaped main pipe 51, thus pushing the horizontal anchor rod 53 to move outward. A portion of the hydraulic oil may flow into the horizontal outer rod, pushing the horizontal inner rod to overcome the spring force between the horizontal inner rod and the horizontal outer rod, causing the horizontal inner rod to extend outward and penetrate into the soil, thereby increasing the length of the horizontal anchor rod 53.

The horizontal anchor rod with a retractable structure may adaptively change the length according to the actual magnitude of the frost heave force, so as to further improve the stability of the pile foundation cylinder.

In some embodiments, the movable soil-retaining device 55 includes a top fixed cover 551 and N-stage sliding sleeves.

The top fixed cover 551 serves as a mounting base for installing the N-stage sliding sleeves. The top fixed cover 551 is fixedly connected to the L-shaped main pipe 51 in various ways, such as clamping, welding, etc. The top fixed cover 551 is configured as a cylindrical structure. One end of the top fixed cover 551 is hermetically connected to the L-shaped main pipe 51, and another end faces downward along the vertical direction (e.g., the Z direction in FIG. 4).

Each stage of the sliding sleeves in the N-stage sliding sleeves may be slidably connected to one another. Each stage of the sliding sleeves in the N-stage sliding sleeves has a similar structure but different radial dimensions. Among two adjacent stages of the sliding sleeves, an outer surface of one sliding sleeve may be slidably connected to an inner surface of the other sliding sleeve. The outer surface of one sliding sleeve of the N-stage sliding sleeves may be slidably connected to the inner surface of the top fixed cover 551. In some embodiments, the movable soil-retaining device 55 may be made of steel materials, e.g., stainless steel, etc.

In some embodiments, the N-stage sliding sleeves utilize a two-stage sliding sleeve (i.e., N=2). The N-stage sliding sleeves include a first-stage sliding sleeve 552 and a second-stage sliding sleeve 553. The first-stage sliding sleeve 552 is vertically slidably installed in the top fixed cover 551 through a slideway. The second-stage sliding sleeve 553 is vertically slidably installed in the first-stage sliding sleeve 552 through a slideway.

The slideway refers to a structure for guiding the relative sliding between the first-stage sliding sleeve 552 and the top fixed cover 551, between the second-stage sliding sleeve 553 and the first-stage sliding sleeve 552. In some embodiments, the slideway is disposed the first-stage sliding sleeve 552 and the top fixed cover 551, or between two adjacent stages of the sliding sleeves in the N-stage sliding sleeves. The slideway may include a guide groove and a slider. The slider is slidably coupled to the guide groove.

Merely by way of example, the guide groove may be disposed on an inner surface of the top fixed cover 551. The slider may be disposed on an outer surface of the first-stage sliding sleeve 552. Alternatively, between two adjacent stages of sliding sleeves, the guide groove may be disposed on an inner surface of one sliding sleeve, and the slider may be disposed on an outer surface of the other sliding sleeve. In some embodiments, the positions of the guide groove and the slider may be reversed.

In some embodiments, the second-stage sliding sleeve 553 is fixedly installed on the frost heave force sensing base 54. The top fixed cover 551 is fixedly installed at the bottom of the vertical pipe section of the L-shaped main pipe 51. When backfilling the foundation hole 10 with the foundation soil, the movable soil-retaining device 55 may block the foundation soil and prevent the foundation soil from accumulating above the movable soil-retaining device 55. When the soil undergoes the frost heave action, the movable soil-retaining device 55 may also prevent the surrounding soil from exerting a downward force on the frost heave force sensing base 54. Moreover, the N-stage sliding sleeves may expand and contract in the vertical direction, so it will not impede the upward movement of the frost heave force sensing base 54.

In some embodiments, the liquid capsule 6 is embedded inside the movable soil-retaining device 55.

The liquid capsule 6 refers to a structure used for holding liquid. For example, the liquid capsule 6 may hold the hydraulic oil. The liquid capsule 6 may be made of a flexible material, such as rubber, plastic, or the like.

An end of the liquid capsule 6 facing the frost heave force sensing base 54 may be connected to the frost heave force sensing base 54, e.g., via bonding, snap-fit, etc. The sliding rod 52 is a hollow rod, i.e., having a liquid channel 521 inside. A through-hole 591 is also centrally disposed in the first piston 59 at the top end of the sliding rod 52. The through-hole 591 communicates with the liquid channel 521 of the sliding rod 52. The liquid capsule 6 communicates with the bottom side of the liquid channel 521 of the sliding rod 52 through a connecting pipe 61, so that the liquid capsule 6 communicates with an internal space of the L-shaped main pipe 51 between the first piston 59 and the second piston 533. The liquid capsule 6, the liquid channel 521 of the sliding rod 52, and the internal space of the L-shaped main pipe 51 between the first piston 59 and the second piston 533 is filled with the hydraulic oil.

The liquid capsule is embedded inside the movable soil-retaining device of the frost heave penetration mechanism provided in some embodiments of the present disclosure, the liquid channel is provided inside the sliding rod, and the liquid capsule communicates with a bottom side of the sliding rod via the connecting pipe, such that the liquid capsule communicates with the internal space of the L-shaped main pipe between the first piston and the second piston.

After backfilling the soil, when the soil undergoes the frost heave action, during the movable soil-retaining device 55 is compressed, the liquid capsule 6 is squeezed, forcing the hydraulic oil in the liquid capsule 6 to flow, through the liquid channel 521 of the sliding rod 52 and the through-hole 591 of the first piston 59, into the internal space of the L-shaped main pipe 51, to increase an oil pressure within the L-shaped main pipe 51 and enhance a driving force on the second piston 533 to prompt outward extension of the horizontal anchor rod 53.

In some embodiments, during the process of installing the frost-heave-resistant pile foundation support device and backfilling the foundation soil, the movable soil-retaining device 55 remains expanded. When the soil undergoes the frost heave action, due to the great frost heave force, the frost heave force may push the movable soil-retaining device 55 upward, and the movable soil-retaining device 55 pushes the sliding rod 52 to move upward against the spring force of the spring 57.

Some embodiments of the present disclosure provide a frost-heave-resistant pile foundation support device, which has the advantage of simple construction. During construction, the foundation hole is excavated, the threaded drill rod is installed, and then the foundation soil is backfilled. There is no need for large-area excavation in the original foundation or pouring of concrete, which avoids the alkalization of the construction region caused by the concrete that affects the growth of surrounding vegetation. It is especially suitable for natural reserves with the frozen soil, avoiding ecological damage.

Some embodiments of the present disclosure provide a frost-heave-resistant pile foundation support device having the frost heave penetration mechanism. The frost heave force sensing base is configured to sense the frost heave force of the soil and drive the sliding rod to move upward under the frost heave force. Before the frost heave occurs, the bottom end of the sliding rod extends beyond the bottom of the vertical pipe section of the L-shaped main pipe, reserving space for upward movement. When backfilling the foundation soil, the movable soil-retaining device ensures that there is a movement space between the frost heave force sensing base and the bottom of the vertical pipe section of the L-shaped main pipe. There is no foundation soil in the movement space, which is not affected by the downward frost heave force of the soil. At the same time, the movable soil-retaining device allows the frost heave force sensing base to move upward. After completion of the backfilling and embedding, when soil undergoes frost heave action, the frost heave force sensing base is forced to move upward, simultaneously, the movable soil-retaining device is compressed to drive the sliding rod to move vertically upward to actuate the horizontal anchor rod to penetrate laterally outward into the soil.

In some embodiments, the frost-heave-resistant pile foundation support device further includes a sensor and a processor.

The sensor is configured to acquire meteorological data, soil data, hydraulic data, etc. More descriptions regarding the processor, the soil data, and the hydraulic data may be found in FIG. 4 and relevant descriptions thereof.

The meteorological data refers to data related to the weather in the region where the pile foundation cylinder is located. In some embodiments, the meteorological data may include air temperature, snowfall amount, day-night temperature difference, wind speed, solar radiation, etc.

In some embodiments, the sensor may be disposed at a plurality of predetermined locations. For example, the sensor is installed around the vertical pipe section of the L-shaped main pipe 51 or the sliding rod 52, and is configured to monitor the hydraulic data in the L-shaped main pipe 51 or the displacement of the sliding rod 52. As another example, the sensor is installed near the cylindrical wall of the pile foundation cylinder 1, the frost heave penetration mechanism mounting bracket 11, and the frost heave force sensing base 54 to obtain the soil data.

In some embodiments, the sensor and a power device 536 may be respectively in communication connection with the processor, which may be arranged inside the pile foundation cylinder 1 or the frost heave penetration mechanism 5.

In some embodiments, the processor is configured to: before the formation of the frozen soil, generate the frost heave force distribution of the soil based on the meteorological data and the soil data; and determine the penetration depth of the horizontal anchor rod based on the frost heave force distribution.

The frost heave force distribution refers to a distribution of the intensity of the frost heave force at different positions in the soil.

In some embodiments, the processor may determine the frost heave force distribution through the intensity prediction model based on the meteorological data and the soil data.

The intensity prediction model refers to a model used to determine the frost heave force distribution. In some embodiments, the intensity prediction model is a machine learning model, e.g., a Neural Networks (NN) model, etc.

The input of the intensity prediction model includes the meteorological data and the soil data, and the output includes the frost heave force distribution.

In some embodiments, the processor may train the intensity prediction model based on a second sample dataset.

The second sample dataset includes a second training sample and a corresponding second label.

In some embodiments, the second training sample includes sample meteorological data and sample soil data. The second label is the frost heave force distribution that actually corresponds to each second training sample.

In some embodiments, the processor may determine the actual measured frost heave force distribution in the historical data, and the actual meteorological data and the actual soil data corresponding to the same time point. The actual frost heave force distribution may be measured by professional equipment during a historical time period. For example, a high-precision ground radar obtains the actual frost heave force distribution in a deep or localized region of frozen soil. The processor may determine the actual meteorological data and the actual soil data as the second training sample, and determine the frost heave force distribution corresponding to the second training sample as the second label.

In some embodiments, the training of the intensity prediction model is similar to the training of the distribution determination model. More descriptions regarding the training of the intensity prediction model may refer to relevant descriptions of the training of the distribution determination model in FIG. 4.

In some embodiments, the processor may determine the penetration depth of the horizontal anchor rod based on the frost heave force distribution.

The penetration depth refers to a distance that the horizontal anchor rod penetrates into the soil from the end of the L-shaped main pipe 51. The penetration depth may be positively correlated with the frost heave force at the location where the horizontal anchor rod is located.

In some embodiments, the processor may construct a depth data table. The depth data table includes the historical frost heave force and historical penetration depth in the historical data, and their corresponding relationships. The processor may determine the penetration depth by querying the depth data table based on the current frost heave force.

In some embodiments, the processor may determine the penetration depth based on the frost heave force distribution and a load distribution.

The load distribution refers to a distribution of the loads on the top portion of the pile foundation cylinder. In some embodiments, the load distribution may include a magnitude of the load and a distribution position. The distribution position may be represented by coordinates. The magnitude of the load may be obtained through sensors.

In some embodiments, the processor may determine the penetration depth through a depth determination model based on the frost heave force distribution and the load distribution.

The depth determination model refers to a model used to determine the penetration depth. In some embodiments, the depth determination model is a machine learning model, e.g., a Neural Networks (NN) model, etc.

The input of the depth determination model includes the frost heave force distribution and the load distribution, and the output includes the penetration depth.

In some embodiments, the processor may train the intensity prediction model based on a third sample dataset.

The third sample dataset includes a third training sample and a corresponding third label.

In some embodiments, the third training sample includes a sample frost heave force distribution and a sample load distribution. The third label is the penetration depth that actually corresponds to each third training sample.

In some embodiments, the processor may determine a plurality of historical preferred schemes from the plurality of distribution schemes actually applied in the historical data. The processor determines the historical frost heave force distribution and the historical load distribution corresponding to the historical preferred scheme as the third training sample. The processor determines the actual penetration depth corresponding to the historical preferred scheme as the third label corresponding to the third training sample. More descriptions regarding the historical preferred scheme may be found in FIG. 4 and relevant descriptions thereof.

By predicting the penetration depth, it is possible to determine in advance a depth to which the horizontal anchor rod needs to penetrate into the soil before the soil undergoes the frost heave action, which ensures that the penetration depth of the horizontal anchor rod meets the requirements and avoids the need for subsequent readjustments. At the same time, it is possible to adaptively adjust the penetration depth according to the actually detected load distribution and the predicted frost heave force distribution, making the determined penetration depth more in line with the actual situation. Determining the penetration depth through the depth determination model can improve the accuracy and efficiency of determining the penetration depth.

In some embodiments, the input of the depth determination model also includes the load distribution of an adjacent pile foundation cylinder. The processor of the current pile foundation cylinder may be communicatively connected to the processor of the adjacent pile foundation cylinder through a communication module, so as to achieve data transmission. The processor of the current pile foundation cylinder may obtain the load distribution of the adjacent pile foundation cylinder through the communication module.

When determining the penetration depth, by taking into account the load distribution of the adjacent pile foundation cylinder, it is possible to coordinately adjust the penetration depths of the current pile foundation cylinder and the adjacent pile foundation cylinder, which avoids the situation where the penetration depths of two adjacent pile foundation cylinders at the same position are relatively large that causes the phenomenon of stress concentration at that position.

By using the intensity prediction model, it is possible to predict the frost heave force distribution based on the actually detected meteorological data and soil data before the soil undergoes the frost heave action. The horizontal anchor rods are inserted into the soil in advance according to the frost heave force distribution, so as to play a preventive role, which avoids starting the operation after the soil has undergone the frost heave action, thus eliminating the risk of the pile foundation cylinder being lifted up. Predicting the frost heave force distribution by using the intensity prediction model can improve the accuracy and efficiency of the prediction.

In some embodiments, a front end of the horizontal anchor rod 53 is formed as a tapered tip structure. For example, the front end of the horizontal anchor rod 53 is formed as a tapered structure, which facilitates the horizontal anchor rod 53 to penetrate outward into the soil.

In some embodiments, the horizontal anchor rod 53 is further provided with barbs 531. The barbs 531 can increase the contact area between the horizontal anchor rod 53 and the soil, facilitating the stabilization of the horizontal anchor rod 53 in the soil after penetrating into the soil. The barb 531 refers to a structure that protrudes outward relative to an outer surface of the horizontal anchor rod 53. The end of the barb 531 may be arranged to incline towards the inside of the L-shaped main pipe 51. A plurality of barbs 531 may be provided, and the plurality of barbs 531 are evenly distributed on the side surface of the horizontal anchor rod 53. When the horizontal anchor rod 53 has a tendency to retract into the L-shaped main pipe 51, the barbs 531 may increase the resistance of the horizontal anchor rod 53, thereby preventing the horizontal anchor rod 53 from retracting.

Figure 7:
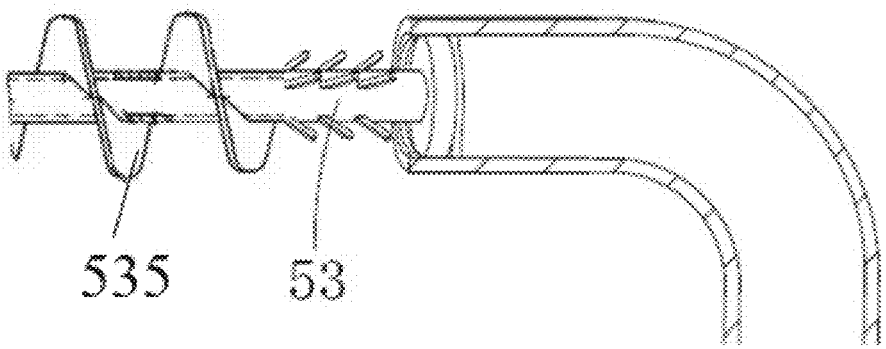
FIG. 7 is a schematic diagram illustrating a structure of a helical blade according to some embodiments of the present disclosure.
Figure 8:
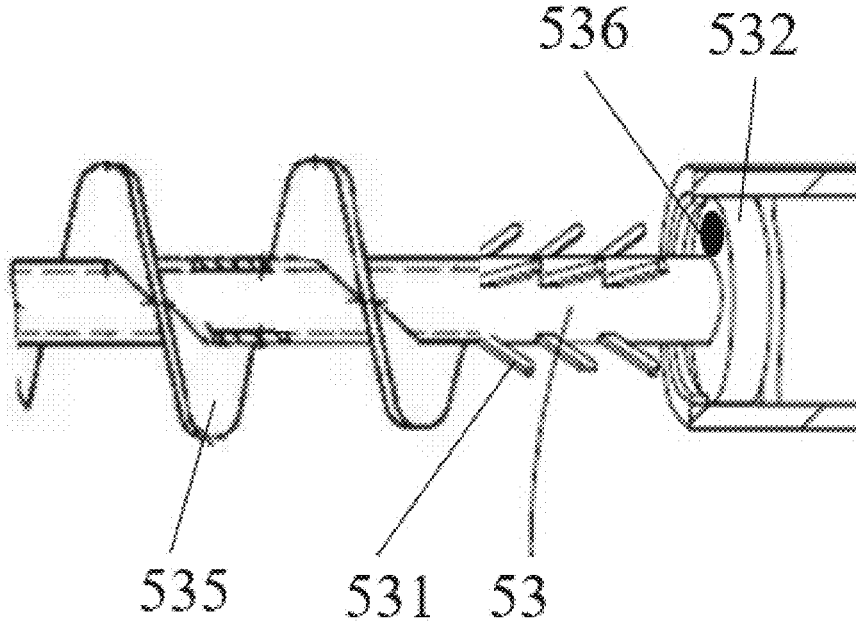
FIG. 8 is a schematic diagram illustrating a position of a power device according to some embodiments of the present disclosure.

FIG. 7 is a schematic diagram illustrating a structure of a helical blade according to some embodiments of the present disclosure. FIG. 8 is a schematic diagram illustrating a position of a power device according to some embodiments of the present disclosure.

In some embodiments, as shown in FIG. 7 and FIG. 8, the horizontal anchor rod 53 further includes a helical blade 535 and a power device 536.

The helical blade 535 is distributed in a helical shape along the circumferential direction of the horizontal anchor rod 53. In some embodiments, the horizontal anchor rod 53 is rotatably connected to the sliding guide member 532, and the rotation center of the horizontal anchor rod 53 is the axis of the horizontal anchor rod 53. The horizontal anchor rod 53 and the sliding guide member 532 may be connected through a bearing.

In some embodiments, the helical blade 535 is connected to the horizontal anchor rod 53 in various ways, such as welding, snap-fit, one-piece molding, or the like. The dimensions (e.g., length, diameter, spacing, etc.) of the helical blade 535 are preset values, which may be set according to actual needs. The helical blade 535 may be made of a plurality of materials, such as steel, aluminum alloy, or the like.

In some embodiments, the barbs 531 may be disposed between the helical blade 535 and the sliding guide member 532.

The power device 536 is configured to output power. For example, the power device 53 outputs torque to drive the horizontal anchor rod 53 to rotate. In some embodiments, the power device 536 may include a motor and a speed reducer. The speed reducer is drive-connected between the motor and the horizontal anchor rod 53, and the motor is disposed on the sliding guide member 532. The speed reducer may include a chain drive mechanism, a gear drive mechanism, or the like.

During the process of the horizontal anchor rod 53 penetrating into the soil, the power device 536 drives the horizontal anchor rod 53 to rotate, enabling the helical blade 535 to turn and cut into the soil. When the depth at which the horizontal anchor rod 53 penetrates into the soil reaches a preset value, the power device 536 may stop outputting power, so that the horizontal anchor rod 53 remains fixed.

In some embodiments, a protective cover may be provided on the sliding guide member 532. The protective cover is configured to shield the power device 536, preventing mud, etc., from entering inside the power device 536 and affecting a normal operation of the power device 536.

By setting the helical blade on the horizontal anchor rod and making the horizontal anchor rod rotate during the process of penetrating into the soil, the resistance during the movement of the horizontal anchor rod can be reduced, and the contact area between the horizontal anchor rod and the soil can be increased, which is conducive to further improving a connection strength between the horizontal anchor rod and the soil, thus enhancing the stability of the pile foundation cylinder.

In some embodiments, a limit ring 534 is further provided at a front end of the horizontal pipe section of the L-shaped main pipe 51. The horizontal anchor rod 53 may pass through the limit ring 534, while the sliding guide member 532 cannot pass through the limit ring 534. The limit ring 534 may be configured to restrict a maximum outward displacement of the horizontal anchor rod 53, preventing the horizontal anchor rod 53 from disengaging. The limit ring 534 may be connected to the L-shaped main pipe 51 in various ways, such as snap-fit, welding, threaded connection, or the like.

In some embodiments, there are a plurality of frost heave penetration mechanisms, which are evenly disposed along the circumferential direction of the pile foundation cylinder 1 on the cylindrical wall of the pile foundation cylinder 1. When the soil undergoes the frost heave action, the horizontal anchor rods 53 of the plurality of frost heave penetration mechanisms 5 may simultaneously penetrate into the surrounding soil, which further enhances the stability of the pile foundation cylinder 1.

Figure 9:
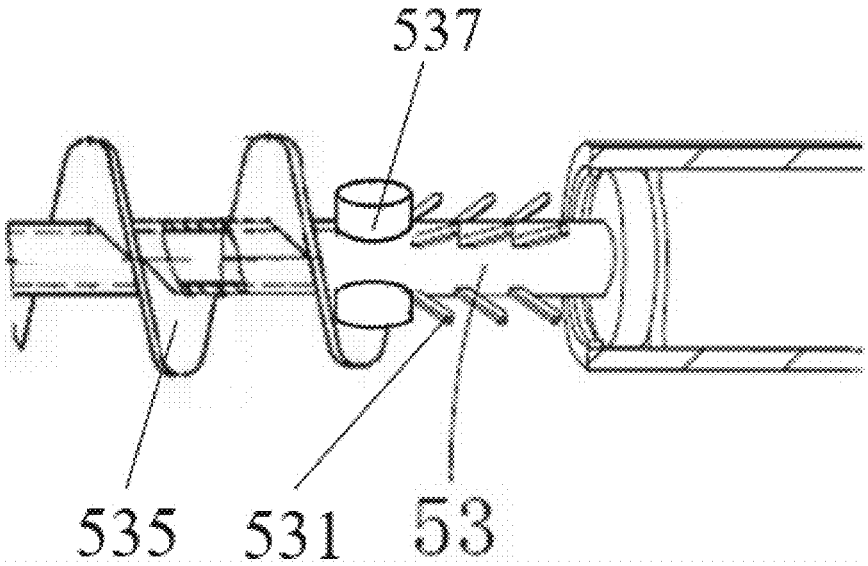
FIG. 9 is a schematic diagram illustrating a structure of a vertical anchor rod according to some embodiments of the present disclosure.

FIG. 9 is a schematic diagram illustrating a structure of a vertical anchor rod according to some embodiments of the present disclosure.

In some embodiments, as shown in FIG. 9, the horizontal anchor rod 53 is provided with an anchor rod channel. The axis of the anchor rod channel is perpendicular to the axis of the horizontal anchor rod 53, and a vertical anchor rod 537 is arranged in the anchor rod channel.

In some embodiments, the anchor rod channel may be arranged between the helical blade and the barb 531.

The vertical anchor rod 537 may be configured to penetrate into the soil, so as to increase the connection strength between the frost heave penetration mechanism 5 and the soil. The axis of the vertical anchor rod 537 is perpendicular to the axis of the horizontal anchor rod 53, enabling the vertical anchor rod 537 to withstand the frost heave force along the axial direction of the horizontal anchor rod 53, thus further enhancing the stability of the pile foundation cylinder 1.

In some embodiments, the vertical anchor rod 537 is slidably disposed within the anchor rod channel. A first elastic structure is arranged between the vertical anchor rod 537 and the horizontal anchor rod 53. In some embodiments, the vertical anchor rod 537 is configured as a retractable structure, and the vertical anchor rod 537 further includes a second elastic structure controlling the retraction of the vertical anchor rod 537.

When the horizontal anchor rod 53 is disposed inside the L-shaped main pipe 51, the first elastic structure or the second elastic structure is in a compressed state. Under the action of the first elastic structure or the second elastic structure, the vertical anchor rod 537 abuts against the inner wall of the L-shaped main pipe 51. When the horizontal anchor rod 53 penetrates outwardly and drives the vertical anchor rod 537 to move to the outside of the L-shaped main pipe 51, under the action of the first elastic structure or the second elastic structure, the vertical anchor rod 537 penetrates outward into the soil The first elastic structure or the second elastic structure may include a spring, a spring leaf, or the like.

When the vertical anchor rod 537 is constructed in a retractable structure, the vertical anchor rod 537 may include a multi-stage casing. Two adjacent stages of casings in the multi-stage casing are slidably connected in sequence, and the two adjacent stages of casings are connected by the second elastic structure.

By providing the vertical anchor rod, it is possible to enhance the effect of the frost heave penetration mechanism to withstand loads, which is conducive to enhancing a connection strength between the frost heave penetration mechanism and the surrounding soil.

Having thus described the basic concepts, it may be rather apparent to those skilled in the art after reading this detailed disclosure that the foregoing detailed disclosure is intended to be presented by way of example only and is not limiting. While not expressly stated herein, various modifications, improvements, and amendments may be made to this specification by those skilled in the art. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Finally, it should be understood that the embodiments described in the present disclosure are only used to illustrate the principles of the embodiments of the present disclosure. Other variations may also fall within the scope of the present disclosure. Therefore, as an example and not a limitation, alternative configurations of the embodiments of the present disclosure may be regarded as consistent with the teaching of the present disclosure. Accordingly, embodiments of the present application are not limited to that precisely as shown and described.

What is claimed is:

1. A frost-heave-resistant pile foundation support device, comprising: a pile foundation cylinder, a pile foundation cylinder top seat, a pile foundation cylinder base, and a frost heave penetration mechanism, wherein a top of the pile foundation cylinder is fixedly installed with the pile foundation cylinder top seat, the pile foundation cylinder top seat is configured to connect to a target to be support; the pile foundation cylinder base is disposed at a bottom of the pile foundation cylinder, and a plurality of threaded drill rod assemblies are provided on the pile foundation cylinder base for anchoring to a foundation;

the frost heave penetration mechanism is fixedly installed on a cylindrical wall of the pile foundation cylinder, and the frost heave penetration mechanism includes: an L-shaped main pipe, a sliding rod, a horizontal anchor rod, a frost heave force sensing base, a movable soil-retaining device, and a liquid capsule, wherein the L-shaped main pipe includes a horizontal pipe section at top and a vertical pipe section, a mounting block is fixedly disposed inside the vertical pipe section of the L-shaped main pipe, the sliding rod is vertically slidably mounted within the mounting block, a limit plate is fixedly disposed at a middle portion of the sliding rod, a spring is arranged between the limit plate and the mounting block, and a limit protrusion is provided inside a bottom end of the vertical pipe section of the L-shaped main pipe to restrict the limit plate; a first piston is disposed at a top end of the sliding rod; the horizontal anchor rod is slidably mounted within the horizontal pipe section of the L-shaped main pipe, and a second piston is disposed at a rear end of the horizontal anchor rod;

the frost heave force sensing base is disposed at a bottom end of the sliding rod, and the movable soil-retaining device is arranged between the frost heave force sensing base and the vertical pipe section of the L-shaped main pipe;

the liquid capsule is embedded inside the movable soil-retaining device, a liquid channel is provided inside the sliding rod, and a through-hole is centrally disposed in the first piston, the through-hole communicates with the liquid channel of the sliding rod, and the liquid capsule communicates with a bottom side of the liquid channel of the sliding rod via a connecting pipe, such that the liquid capsule communicates with an internal space of the L-shaped main pipe between the first piston and the second piston;

the liquid capsule, the liquid channel of the sliding rod, and the internal space of the L-shaped main pipe between the first piston and the second piston are filled with hydraulic oil;

the movable soil-retaining device includes a top fixed cover and N-stage sliding sleeves, Nis greater than or equal to 2, the top fixed cover is fixedly sleeved around a bottom of the vertical pipe section of the L-shaped main pipe, and the N-stage sliding sleeves are sequentially slidably nested, an uppermost sliding sleeve is vertically slidably mounted within the top fixed cover, and a lowermost sliding sleeve is fixedly sleeved on the frost heave force sensing base.

2. The frost-heave-resistant pile foundation support device according to claim 1, wherein the pile foundation cylinder base is configured as an inverted cone shape.

3. The frost-heave-resistant pile foundation support device according to claim 1, wherein each of the plurality of the threaded drill rod assemblies includes a threaded barrel, a threaded drill rod, and a protective cap, the threaded barrel is fixedly disposed on the pile foundation cylinder base, the threaded drill rod is threadedly installed through the threaded barrel, the threaded drill rod is configured to drill into the foundation, and the protective cap is mounted on a top end of the threaded drill rod.

4. The frost-heave-resistant pile foundation support device according to claim 1, wherein a frost heave penetration mechanism mounting bracket is provided on a cylindrical wall of the pile foundation cylinder, and the frost heave penetration mechanism is fixed to the frost heave penetration mechanism mounting bracket.

5. The frost-heave-resistant pile foundation support device according to claim 4, wherein a horizontal blocking arm is provided on the frost heave penetration mechanism mounting bracket, and the horizontal pipe section of the L-shaped main pipe is fixedly welded on the horizontal blocking arm.

6. The frost-heave-resistant pile foundation support device according to claim 1, wherein a front end of the horizontal anchor rod is formed as a tapered tip structure, and the horizontal anchor rod is further provided with barbs.

7. The frost-heave-resistant pile foundation support device according to claim 1, wherein a limit ring is further provided at a front end of the horizontal pipe section of the L-shaped main pipe, and is configured to restrict a maximum outward displacement of the horizontal anchor rod.

8. The frost-heave-resistant pile foundation support device according to claim 1, wherein when backfilling and embedding of the pile foundation cylinder, the horizontal anchor rod is positioned inside the horizontal pipe section of the L-shaped main pipe;

after completion of the backfilling and embedding, when soil undergoes frost heave action, the frost heave force sensing base is forced to move upward, simultaneously, the movable soil-retaining device is compressed to drive the sliding rod to move vertically upward to actuate the horizontal anchor rod to penetrate laterally outward into the soil.

9. The frost-heave-resistant pile foundation support device according to claim 8, wherein when the soil undergoes the frost heave action, during the movable soil-retaining device is compressed, the liquid capsule is squeezed, forcing the hydraulic oil in the liquid capsule to flow, through the liquid channel of the sliding rod and the through-hole of the first piston, into the internal space of the L-shaped main pipe, to increase an oil pressure within the L-shaped main pipe and enhance a driving force on the second piston to prompt outward extension of the horizontal anchor rod.

* * * * *